United States Patent [19]

Fordsmand

[11] 4,371,036

[45] Feb. 1, 1983

[54] HEAT EXCHANGER, PARTICULARLY FOR HEAT PUMPS

[76] Inventor: Marc Fordsmand, Skovshovedvej 38, DK-2920 Charlottenlund, Denmark

[21] Appl. No.: 156,272

[22] Filed: Jun. 4, 1980

[51] Int. Cl.[3] ..... F28D 7/02

[52] U.S. Cl. ..... 165/163; 62/399

[58] Field of Search ..... 165/163, 11, 160, 74; 122/250 R; 62/399

[56] References Cited

U.S. PATENT DOCUMENTS

| | | | |
|---|---|---|---|
| 1,893,484 | 1/1933 | Belt | 165/163 X |
| 1,911,042 | 5/1933 | Steenstrub | 62/399 X |
| 2,136,813 | 11/1938 | Dulison | 62/98 |
| 3,163,210 | 12/1964 | Horrocks | 165/163 |
| 4,242,881 | 1/1981 | Williams | 62/399 |

*Primary Examiner*—William R. Cline
*Assistant Examiner*—Theophil W. Streule, Jr.
*Attorney, Agent, or Firm*—Watson, Cole, Grindle & Watson

[57] ABSTRACT

A heat exchanger, particularly for use in heat pumps, either as an evaporator or as a condenser or both, comprises for the flow of a refrigerant one or more pipes helically coiled around a core pipe. This structure is mounted inside a mantle-pipe which serves for the flow of a heat carrying medium, such as water, and is helically coiled around a vertical axis or bent to another compacted shape making the center line of the turns of the helically coiled pipe or pipes extend horizontally or at a slight inclination to the horizontal. The refrigerant is fed to one end of the helically coiled pipe or pipes and then flows back through the core pipe. The heat carrying medium flows through the mantle-pipe in the same general direction as the flow of refrigerant through the helically coiled pipes.

5 Claims, 6 Drawing Figures

HEAT EXCHANGER, PARTICULARLY FOR HEAT PUMPS

BACKGROUND OF THE INVENTION

The invention relates to a heat exchanger, particularly for heat pumps, comprising a secondary part which comprises at least one helically coiled pipe which contains a refrigerant, and a primary part which surrounds the secondary part and serves for the flow of a heat carrying medium.

Heat exchangers of a similar type are known in various forms (for example Swedish patent specification No. 196,760, U.S. Pat. No. 3,526,273 and U.S. Pat. No. 3,163,210). For heat pump installations, two heat exchangers are normally used, namely firstly an evaporator in which the heat carrying medium of a heat source circuit transfers its heat to a refrigerant circuit, and secondly a condenser in which the refrigerant circuit again transfers its heat to a heat carrying medium in a heat delivering circuit. In these two heat exchangers it is desirable to achieve the greatest possible heat transfer and the smallest possible pressure loss.

The possibilities of improving the heat transfer will be understood from the following equation:

$$Q=k\cdot F\cdot \Delta t.$$

All methods of improving the heat transfer factor Q are aimed at optimizing one or all of these influencing factors. In heat pump installations there are certain limits to the increase of the temperature difference $\Delta t$, as it only can be increased at the expense of the output of the compressor, whereby the total output of the heat pump installation is reduced. Improvements in the heat transfer figure "k" can only be achieved by influencing the flow conditions and by choice of materials. Furthermore it is generally known to make the heat exchanger surface "F" as large as possible by constructive measures, e.g. by fixing fins or the like. The helical coiling of the pipes also serves this purpose. However, limitation will often be set by the space requirements of the heat exchanger.

SUMMARY OF THE INVENTION

It is an object of the invention to optimize a heat exchanger of the kind described in the foregoing by increasing the heat exchanger surface in relation to the space requirements and improving the heat transfer figure "k".

According to the invention, a heat exchanger for heat pumps comprises at least one helical pipe forming a secondary part for the flow of a refrigerant, a mantle-pipe surrounding said helical pipe and forming a primary part for the flow of a heat carrying medium, said at least one helical pipe being coiled around a core pipe and extending substantially from one end to the other end of said mantle-pipe, said at least one helical pipe being connected to said core pipe near said other end of said mantle-pipe and being connected near said first end to refrigerant inlet means outside said mantle-pipe, said core pipe being connected near said first end to refrigerant outlet means outside said mantle-pipe, said mantle-pipe having a heat carrying medium inlet at said first end and a heat carrying medium outlet at said other end, the center line of the turns of said at least one helical pipe extending horizontally or at an inclination small enough to ensure that the centrifugal force acting on a liquid refrigerant particle travelling through a turn will alternately be added to and subtracted from the gravity of the same particle, said mantle-pipe with said helical pipe and said core pipe therein being bent to a compacted shape.

The invention primarily originates from the following perception: When a flow takes place through a pipe, centrifugal and gravitational forces act on the flow. If a helically coiled pipe with a combined liquid/gas flow is arranged with a vertical axis, then a resultant of the gravitational and centrifugal forces will be created, which has the effect that the liquid is forced against the lower pipe-wall, whereby the level of the liquid will be inclined with a rise from the inside to the outside. The upper part of the pipe cross-section will however be filled with gas or vapour phase, especially when one has to do with refrigerants, which at least in the inflow region of the heat exchanger have a temperature which is near their boiling point. As is well known, the heat transfer between a gas or a vapour phase and a pipe-wall is smaller than between a liquid and a pipe-wall. Whereas in a helix with a vertical axis the resultant of the gravitational and centrifugal forces has the same direction over the total length of the heat exchanger, this direction changes continually when the helix is arranged with a horizontal axis, as e.g. in the bottom of each turn of the helix the gravitational and the centrifugal forces will be added, whereas they will counteract each other in the top of each turn. This has the effect that the forces which are changing all the time influence the flow through the pipe, whereby the possibility that the whole interior surface of the pipe is covered with liquid increases considerably. This possibility is particularly increased in the case of liquids, which have a tendency to blow-boiling.

The invention thus first and foremost utilizes this favourable arrangement of the helically coiled pipe of the secondary part. Then, in order to obtain the largest possible heat exchanger surface within a certain total volume or area, the invention furthermore provides that the mantle-pipe with said helical pipe and said core pipe therein is bent to a compacted shape. Preferably, the mantle-pipe is likewise helically coiled with its helix axis extending substantially vertically. This has the effect that the center line of the turn of the helix in the secondary part will be maintained in an almost horizontal position. Other possible compacted shapes of the mantle-pipe are a spirally wound coil or a meander configuration.

By the aforementioned measures the heat transfer figure "k" on the one hand, and the heat exchanger surface within limited confines on the other hand, are optimized. Practical experience has furthermore shown that by such a construction of the heat exchanger, especially when it is used as an evaporator, the pressure loss in the primary part can be reduced by about 50% in the primary circuit and by about 90% in the secondary circuit as compared to the pressure loss in conventional heat exchangers. This by the same token means that in spite of the low pressure loss in the refrigerant circuit, it is possible to achieve a good heat transfer.

In the further development of the invention, the helically coiled pipe of the secondary part discharges into the core pipe near the outlet for the liquid in the primary part. This core pipe is placed in the axis of the helical pipe of the secondary part, and its exit is placed near the inflow of the liquid of the primary part. Hereby the advantage is achieved that the refrigerant in the secondary part firstly flows in direct current with the liquid in the primary part. At the end of the helically coiled pipe of the secondary part of the path of flow of the refrigerant is changed, so that it flows in the opposite direction through the core pipe, i.e. in counter direction with the liquid of the primary part. Hereby a maximum of superheating of the vapour is achieved.

In an advantageous embodiment of the invention three parallel helically coiled pipes for the refrigerant are provided in the secondary part, which all discharge into the core pipe. When the refrigerant changes phase from liquid to vapour form in the heat exchanger it is proposed that the core pipe should have a larger cross-sectional area than the sum of the cross-sectional areas of the helically coiled pipes of the secondary part, and the heat exchange should preferably be controlled in such a way that the change into the vapour phase is completed when the refrigerant reaches the entrance to the core pipe.

The special constructional form of the heat exchanger according to the invention furthermore creates the possibility of placing the compressor for the refrigerant in the helical axis of the mantle-pipe of the primary part. Thereby a thermally advantageous construction is made possible, which furthermore has a sound-absorbing effect for the total installation.

DESCRIPTION OF THE PREFERRED EMBODIMENT

Figure 1:
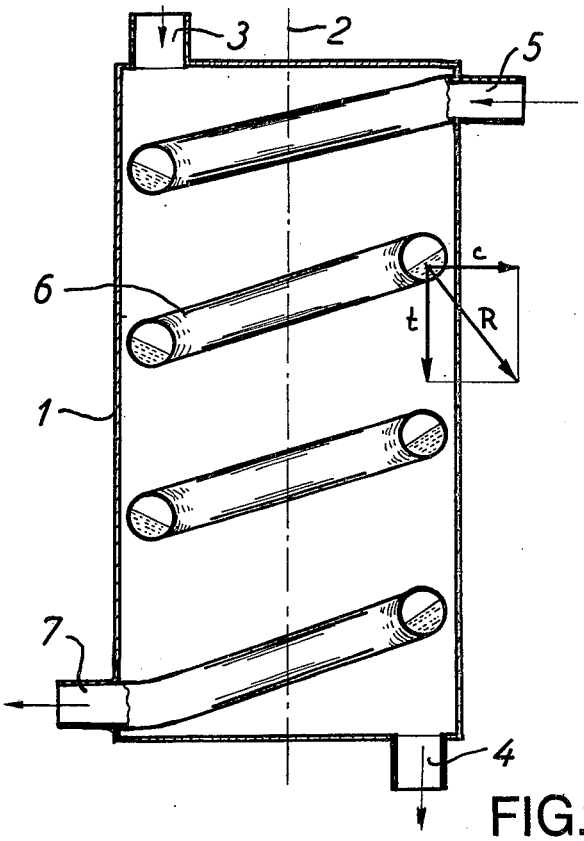
FIG.1. PRIOR ART
FIG. 1 is a schematic longitudinal section through a conventional heat exchanger (evaporator) with a vertically arranged helical pipe in the secondary part.

FIG. 1 shows an evaporator, the primary part of which comprises a cylindrical mantle-pipe 1. The mantle-pipe 1 has at the top an inlet 3 for a heat carrying medium, which for example may be water, and at the bottom an outlet 4. The secondary part comprises a helically coiled pipe 6 in the mantle-pipe 1 having its helical axis 2 vertically arranged and being provided at the top with an inlet 5 for a refrigerant, e.g. Freon, and at the bottom with an outlet 7.

If it is assumed that there is a uniform flow of refrigerant through the pipe 6, the level of the liquid—when there is also a gaseous phase present—will be in a sloping position, as indicated in FIG. 1, on account of the vectorial addition (the resultant) of the gravity "t" and the centrifugal force "c" caused by the velocity of the flow. The liquid level will be positioned perpendicularly to the resultant "R".

It will be noted that in the example of FIG. 1, where the axis 2 of the mantle-pipe 1 is vertical, the centrifugal force "c" will always lie in a horizontal plane, so that—since the gravitational force "t" always pulls vertically downwardly—the angle between the forces "c" and "t" does not change. Consequently, the resultant acting on the refrigerant is the same for all pipe cross-sections, so that the liquid phase of the refrigerant only runs at the bottom of the pipe 6, whereas the refrigerant does not at all come into contact with the areas at the upper part of the pipe.

Figure 3:
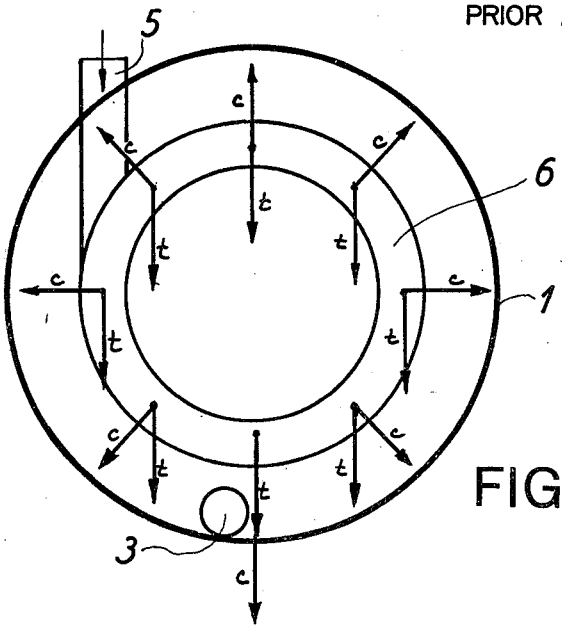
FIG. 3 is a section along the line III—III in FIG. 2.
Figure 2:
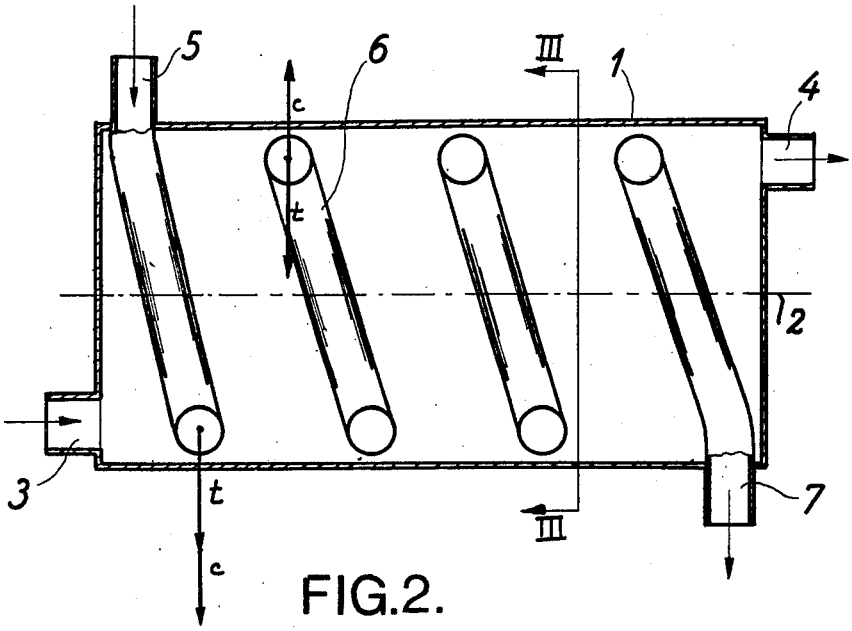
FIG. 2 is a schematic longitudinal section through a heat exchanger with a horizontally arranged helical pipe in the secondary part.

The situation is different when the helical axis 2 of the pipe 6 of the secondary part is not vertical, but horizontal, as shown in FIG. 2 for the same mantle-pipe 1. With a constant flow of the refrigerant through the pipe 6 the centrifugal force "c" is always constant, and it is always radially oriented. However, above the helical axis it is oriented towards the top, and below the helical axis it is oriented towards the bottom. The gravitational force "t", on the other hand, is always directed downwardly. FIG. 3 shows the forces "c" and "t" at various places of the periphery of the pipe 6. It will be seen that the resultant R which is created by the gravity "t" and the centrifugal force "c" continually changes its force and direction, so that the level of the liquid always changes position. When it is furthermore considered that in practice a constant flow and therefore a constant centrifugal force "c" cannot be achieved, as long as the pipe 6 is not completely filled with liquid phase, and that the boiling often takes place as blow-boiling, it will be seen that there is a great probability that the entire inner surface of the pipe will come into contact with the liquid phase of the refrigerant. At any rate, this probability is considerably greater than in the example shown in FIG. 1, even when the disruption of the flow by boiling is considered.

Figure 4A:
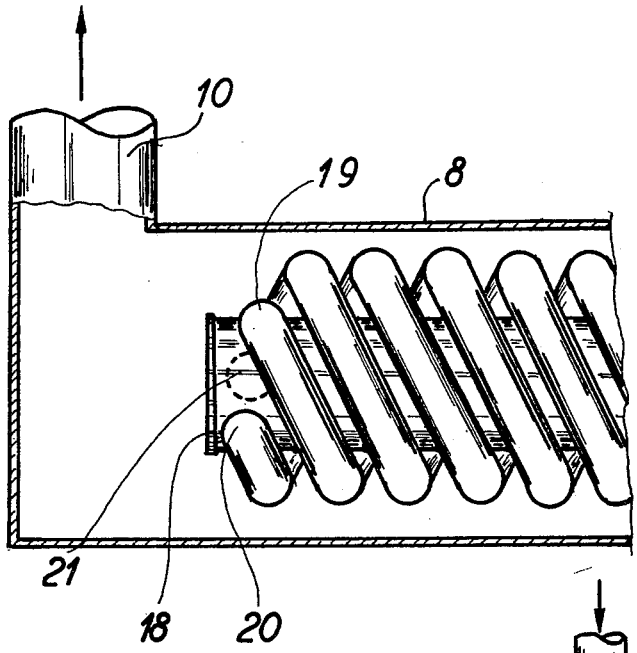
FIG. 4A is a schematic longitudinal section through one end of a coiled heat exchanger according to the invention, further illustrated in FIG. 5.
Figure 4B:
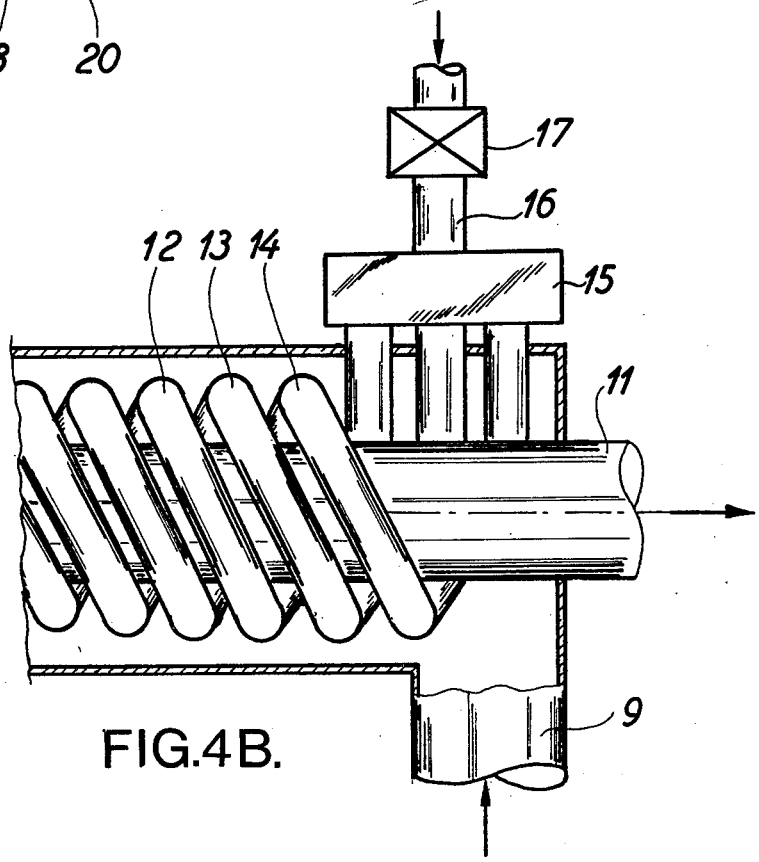
FIG. 4B is a schematic longitudinal section through the other end of the same exchanger.
Figure 5:
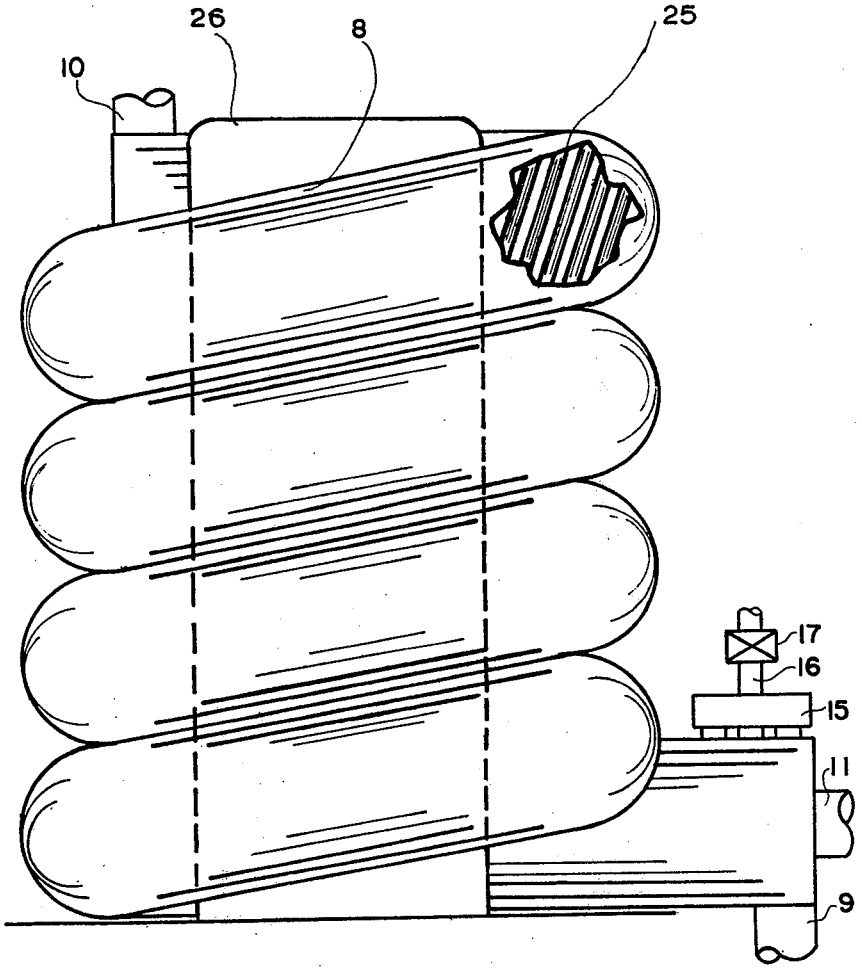
FIG. 5 is a side view of the heat exchanger with compressor.

FIG. 4A shows one end and FIG. 4B the other end of a heat exchanger according to the invention functioning as an evaporator, which is used in a water/water heat pump installation. The heat exchanger has a mantle-pipe 8 as a primary part, which in FIGS. 4A and 4B, for simplicity of illustration, has been shown as being straight, but which over the major part of its length runs helically, as illustrated in FIG. 5. At one end of the mantle-pipe 8 there is an inlet 9 for the heat carrying medium, in this case water, and at the other end an outlet 10 for the water. The mantle-pipe 8 is part of a closed water circuit, to which also a pipe system belongs, which has not been shown, and which for example is placed in the ground in order to pick up heat from the ground. For that reason the water, which runs into the mantle-pipe 8 at the inlet 9, will be hotter than the water which runs out at the outlet 10.

In the mantle-pipe 8 a centrally placed core pipe 11 is part of the secondary circuit. Around this core pipe 11 three parallel copper pipes 12, 13 and 14 are coiled in helical shape. The copper pipes 12, 13 and 14 extend through the mantle-pipe 8 and are joined together in a distributor 15 for the refrigerant, e.g. Freon, which flows into the distributor 15 through a pipe 16. The Freon flow is regulated by a thermostatic valve 17.

Near the end of the mantle-pipe 8, where the outlet 10 is placed, the core pipe 11 is closed by an end plate 18, and the ends of the copper pipes 12, 13 and 14 are joined to the core pipe 11 near its closed end at 19, 20 and 21, respectively, which may for example be arranged around the circumference of the core pipe 11 at an angular spacing of 120°. At its opposite end the core pipe 11 extends to the exterior through the mantle-pipe 8 near the inlet 9 for the heat carrying medium, in order to form an outlet for the refrigerant, as can be seen in FIG. 4B.

As illustrated in FIGS. 4A and 4B the pipes 12, 13 and 14 do not touch the core pipe 11, nor the mantle-pipe 8. However, in practice the pipes 12, 13 and 14 will touch the core pipe 11 at certain places. There may, however, also be arranged several support elements (not shown), for example at the inner wall of the mantle-pipe 8 and/or at the outer wall of the core pipe 11, which keep the pipes 12, 13 and 14 at a distance from the mantle-pipe 8 and the core pipe 11. The mantle-pipe 8 is preferably made from an insulating material, e.g. plastic or rubber. The parts of the pipe system which are located outside the mantle-pipe 8 may be heat insulated.

FIG. 5 shows the coiled arrangement of the mantle-pipe 8 in the preferred embodiment of the heat exchanger (evaporator or condenser) according to the invention. The helically coiled pipes 12, 13 and 14 of the secondary part according to FIGS. 4A and 4B can be seen at 25 in FIG. 5, where the mantle-pipe 8 has been broken away. The heat exchanger according to FIG. 5 is formed by coiling the mantle-pipe 8 of the primary part with the enclosed pipe system of the secondary part helically around a vertical axis. Thereby the horizontal orientation of the helical axis of the inner pipe system is in the main retained. In the example shown the compressor 26 has been placed in the helical axis of the mantle-pipe 8, and is thus surrounded by the mantle-pipe 8. As in FIGS. 4A and 4B the heat carrying medium flows into the mantle-pipe through the inlet 9 and leaves it through the outlet 10. The distributor 15' pipe 15, pipe 16 and the thermostatic valve 17 as well as the outlet 11 of the core pipe are located at the lowermost turn of the helix of the mantle-pipe 8 near the inlet of the primary part.

The operation of the heat exchanger used as evaporator is as follows:

The thermostatic valve 17 is activated by the pressure from a compressor, not shown, in the closed secondary circuit. The thermostatic valve 17 allows a suitable amount of refrigerant to flow into the distributor 15, from which the liquid phase of the refrigerant is distributed in the pipes 12, 13 and 14 (25 in FIG. 5). Then an exchange of heat takes place from the heat carrying medium, for example water, which flows through the inlet 9, to the refrigerant which flows through the pipes 12, 13 and 14 in direct current. The refrigerant evaporates and flows in vapour form to the other end of the helical pipes 12, 13 and 14 (i.e. near the outlet 10 of the mantle-pipe) into the core pipe 11, in which it flows in counter current to the water and thereby is heated even further.

Within the scope of the invention various modifications are possible. For example it is possible to let the three helically coiled pipes 12, 13 and 14 go back to the inlet, the core pipe 11 thus being replaced by three return pipes. Instead of a mounting helix, as shown in FIG. 5, the mantle-pipe 8 may also be coiled in a horizontal level in the manner of a spiral.

I claim:

1. A heat exchanger, particularly for heat pumps, comprising at least one helical pipe forming part of a secondary part for the flow of a refrigerant, a mantle-pipe surrounding said at least one helical pipe and forming a primary part for the flow of a heat carrying medium, a core pipe also forming part of said secondary part, said at least one helical pipe being coiled around said core pipe and extending substantially from one end to the other end of said mantle-pipe, both said helical pipe and said core pipe being in heat exchange relationship with the flow of the heat carrying medium in said mantle-pipe, refrigerant inlet means and outlet means both located outside said mantle-pipe, said at least one helical pipe being connected to said core pipe near said other end of said mantle-pipe and being connected near said one end to said refrigerant inlet means, said core pipe being connected near said one end to said refrigerant outlet means, said mantle-pipe having a heat carrying medium inlet at said first end and a heat carrying medium outlet at said other end, the center line of the turns of said at least one helical pipe extending horizontally or at an inclination small enough to ensure that the centrifugal force acting on a liquid refrigerant particle travelling through a turn will alternatively be added to and subtracted from the gravity of the same particle, said mantle-pipe with said helical pipe and said core pipe therein being bent to a compacted shape.

2. A heat exchanger as in claim 1 in which said mantle-pipe with said helical pipe and said core pipe therein is helically coiled.

3. A heat exchanger as in claim 1, particularly for refrigerants which change phase from liquid to vapour during exchange of heat, wherein a plurality of helical pipes are jointly coiled around said core pipe, and said core pipe has a larger cross-section than the sum of the cross-sections of said helically coiled pipes.

4. A heat exchanger as in claim 2, wherein a compressor is arranged in the secondary part and wherein said compressor is placed in the axis of said helically coiled mantle-pipe of the primary part.

5. A heat exchanger as in claim 1, wherein said secondary part comprises three parallelly coiled helical pipes for the refrigerant, which respectively are connected to said core pipe near the outlet of said primary part.

* * * * *